US006662555B1

(12) United States Patent
Ishii

(10) Patent No.: US 6,662,555 B1
(45) Date of Patent: Dec. 16, 2003

(54) CATALYZER ARRANGEMENT FOR ENGINE

(75) Inventor: Yasushi Ishii, Shizuoka (JP)

(73) Assignee: Yamaha Marine Kabushiki Kaisha, Shizuoka (JP)

( * ) Notice: Subject to any disclaimer, the term of this patent is extended or adjusted under 35 U.S.C. 154(b) by 23 days.

(21) Appl. No.: 09/591,765

(22) Filed: Jun. 12, 2000

(30) Foreign Application Priority Data

Jun. 11, 1999 (JP) ..... 11-165707

(51) Int. Cl.[7] ..... F01N 3/10
(52) U.S. Cl. ..... 60/302; 60/99; 60/313
(58) Field of Search ..... 60/298, 299, 302, 60/313, 320, 323; 440/89, 88

(56) References Cited

U.S. PATENT DOCUMENTS

| | | | | |
|---|---|---|---|---|
| 4,452,194 A | | 6/1984 | Watanabe | |
| 4,735,046 A | | 4/1988 | Iwai | |
| 4,772,236 A | * | 9/1988 | Takahashi | 60/302 |
| 4,848,082 A | | 7/1989 | Takahashi et al. | |
| 4,900,282 A | | 2/1990 | Takahashi et al. | |
| 5,174,112 A | | 12/1992 | Sougawa et al. | |
| 5,239,825 A | | 8/1993 | Shibata | |
| 5,280,708 A | | 1/1994 | Sougawa et al. | |
| 5,346,417 A | * | 9/1994 | Isogawa | 60/302 |
| 5,365,733 A | * | 11/1994 | Takeshima et al. | 60/278 |
| 5,372,530 A | * | 12/1994 | Holtermann et al. | 60/314 |
| 5,378,180 A | | 1/1995 | Nakayama et al. | |
| 5,439,651 A | | 8/1995 | Kato | |
| 5,443,547 A | * | 8/1995 | Morikawa | 60/274 |
| 5,494,467 A | * | 2/1996 | Sohgawa et al. | 440/89 |
| 5,743,774 A | | 4/1998 | Adachi et al. | |
| 5,911,608 A | * | 6/1999 | Nakayama et al. | 60/299 |
| RE36,888 E | * | 10/2000 | Sougawa et al. | 60/302 |
| 6,237,330 B1 | * | 5/2001 | Takahashi et al. | 60/285 |

FOREIGN PATENT DOCUMENTS

| | | |
|---|---|---|
| EP | 0 779 206 A1 | 6/1997 |
| JP | 6-193441 | 7/1994 |
| JP | 7-189671 | 7/1995 |
| JP | 2901097 | 6/1999 |

OTHER PUBLICATIONS

European Search Report, dated Sep. 28, 2000.

* cited by examiner

*Primary Examiner*—Thomas Denion
*Assistant Examiner*—Diem T Tran
(74) *Attorney, Agent, or Firm*—Knobbe, Martens, Olson & Bear, LLP

(57) ABSTRACT

A catalyzer arrangement for an engine includes an improved construction that does not require a large space for furnishing a relatively large volume catalyzer. The engine is surrounded by a protective cowling. A cylinder body of the engine has a plurality of cylinder bores spaced apart from each other. The engine also has an exhaust manifold to gather exhaust gases from the respective cylinder bores. An exhaust passage is coupled to the manifold and extends, at least in part, within a space defined between a side surface of the cylinder body and the protective cowling. At least one catalyzer is disposed in the exhaust passage.

38 Claims, 9 Drawing Sheets

CATALYZER ARRANGEMENT FOR ENGINE

PRIORITY INFORMATION

This application is based on and claims priority to Japanese Patent Application No. 11-165,707, filed Jun. 11, 1999, the entire contents of which is hereby expressly incorporated by reference.

BACKGROUND OF THE INVENTION

1. Field of the Invention

This invention relates to a catalyzer arrangement for an engine, and more particularly to an improved catalyzer arrangement that is suitable to an engine of an outboard motor.

2. Description of Related Art

A typical outboard motor includes an engine for powering a propulsion device. A protective cowling surrounds the engine. The engine and protective cowling together define a power head of the outboard motor. A driveshaft housing depends from the power head and supports a driveshaft that extends from a crankshaft of the engine. A lower unit depends from the driveshaft housing and carries a propulsion device, such as, for example, a propeller that is driven by the driveshaft through a propulsion shaft. The engine is provided with an exhaust system that discharges exhaust gases from the motor.

A typical exhaust system generally comprises three exhaust passages. The first passage is disposed within the engine or on the engine and within the protective cowling. The first passage leads exhaust gases away from the engine. The second passage is disposed within the driveshaft housing and the lower unit and guides the exhaust gases to the third passage. The second passage also silences exhaust noise by passing the exhaust gases through at least one expansion chamber. The third passage is defined within a hollow hub of the propeller and terminates at a discharge port formed at the end of the hub. Normally, an idle exhaust passage with an idle discharge port is provided in the driveshaft housing above the water line of the body of water that surrounds the outboard motor. The majority of the exhaust gasses are discharged to the body of water through the discharge port of the propeller hub, while the idle exhaust gasses are discharged to the atmosphere through the idle discharge port.

It is quite important for environmental concerns to remove hydrocarbons and the like from exhaust gases. For at least this reason, the exhaust gases often are purified with a catalyzer that is disposed within the exhaust system. The catalyzer includes components that chemically react with the exhaust gases in a manner that renders certain of the exhaust gas constituents substantially environmentally harmless. The larger the catalyzer is, the greater its efficiency is; however, because the engine is surrounded by the protective cowling, space is at a premium and limited areas are available for positioning the catalyzer. If the engine has multiple cylinder bores, properly positioning the catalyzer becomes more difficult. Moreover, if a large single catalyzer or small multiple catalyzers are used to treat exhaust gases coming from the respective cylinder bores, finding adequate space within the cramped confines of the cowling becomes very difficult.

In one arrangement, such as that disclosed by U.S. Pat. No. 5,239,825, a catalyzer arrangement for a multiple cylinder engine features a single catalyzer that is disposed in the first exhaust passage and sideward of the engine. Although the arrangement is compact, the catalyzer is somewhat bulky.

U.S. Pat. No. 5,378,180 discloses another arrangement in which a catalyzer is disposed also in the first exhaust passage but rearward of an engine. This type of arrangement, however, requires a large amount of space rearward of the engine. It is undesirable to expand the motor rearward because such a construction would make handling of the motor more difficult. Additionally, if the engine operates on a four-stroke combustion principle, a voluminous valve system is disposed in this space and consumes a majority of the available area.

U.S. Pat. Nos. 5,174,112 and 5,280,708 disclose further arrangements of catalyzers. The catalyzers in these patents are disposed in the second exhaust passages that are positioned within the driveshaft housing. Although a relatively large capacity is available with the catalyzer in this arrangement, the catalyzer is likely positioned proximate the water line. As is known, catalyzers can be fouled or shattered by contact with water. Accordingly, positioning the catalyzers proximate the water line is disadvantageous due to the possibility of water back flow through the exhaust system. Thus, catalyzers preferably are positioned well above the water line or the exhaust system preferably includes a shelter that can protect the catalyzers from water contact.

A need therefore exists for an improved catalyzer arrangement that does not require a large space within an outboard motor for furnishing a catalyzer that has a relatively large volume, and that does not substantially increase the likelihood that the catalyzer will be contacted by water.

SUMMARY OF THE INVENTION

In accordance with one aspect of the present invention, an internal combustion engine is provided for an outboard motor. The outboard motor has a protective cowling surrounding the engine. The engine comprises a cylinder body in which a plurality of cylinder bores are spaced apart from each other. An exhaust manifold gathers exhaust gases from the respective cylinder bores. An exhaust passage is coupled to the manifold and extends, at least in part, within a space defined between a side surface of the cylinder body and the protective cowling. A catalyzer is disposed in the exhaust passage.

In accordance with another aspect of the present invention, an exhaust gas purifying system is provided for an internal combustion engine. The engine has a side surface. The purifying system comprises an exhaust passage disposed on the side surface of the engine for catalytic exhaust treatment. The exhaust passage communicates with the engine through an inlet opening and an outlet opening. At least one catalyzer is disposed between the inlet and outlet openings.

In accordance with a further aspect of the present invention, an exhaust gas purifying system is provided for an internal combustion engine. The engine has a side surface. The purifying system comprises an exhaust passage disposed on the side surface of the engine for catalytic exhaust treatment. The exhaust passage includes a vertical section extending generally vertically along the side surface of the cylinder body. A catalyzer is disposed within the vertical section.

Further aspects, features and advantages of this invention will become apparent from the detailed description of the preferred embodiments which follow.

BRIEF DESCRIPTION OF THE DRAWINGS

These and other features of this invention will now be described with reference to the drawings of a couple of preferred embodiments which are intended to illustrate and not to limit the invention.

DETAILED DESCRIPTION OF THE PREFERRED EMBODIMENTS OF THE INVENTION

Figure 1:
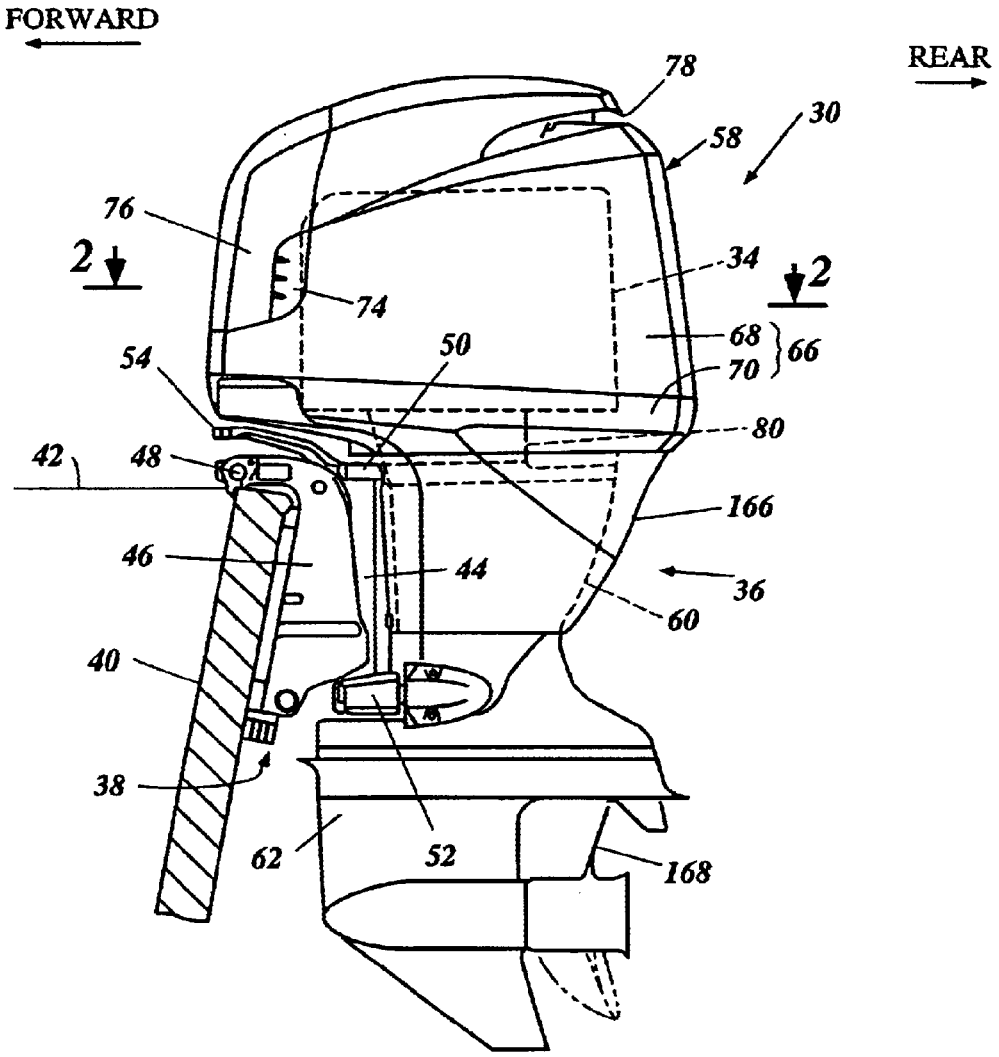
FIG. 1 is a side elevational view of an outboard motor that employs an exhaust unit configured in accordance with a preferred arrangement of the present invention. An associated watercraft on which the motor is mounted is partially shown in section.

With reference to FIGS. 1 to 7, an outboard motor 30 employs an exhaust unit 32 configured in accordance with a preferred embodiment of the present invention. The exhaust unit 32 is provided around an internal combustion engine 34 of the motor 30. Although the present invention is shown in the context of the illustrated outboard motor, various aspects and features of the present invention also can be employed with engines for other types of marine outboard drive units (e.g., a stern drive unit) and land vehicles, as well as with stationary engines used in other types of devices, e.g., generators.

In the illustrated arrangement, the outboard motor 30 comprises a drive unit 36 and a bracket assembly 38. The bracket assembly 38 supports the drive unit 36 on a transom 40 of an associated watercraft 42 so as to place a marine propulsion device in a submerged position with the watercraft 42 resting on the surface of a body of water. The bracket assembly 38 comprises a swivel bracket 44, a clamping bracket 46, a steering shaft and a pivot pin 48.

The steering shaft extends through the swivel bracket 44 and is affixed to the drive unit 36 with an upper mount assembly 50 and a lower mount assembly 52. The steering shaft is pivotally jounaled for steering movement about a generally vertically extending steering axis within the swivel bracket 44. A steering handle 54 extends upwardly and forwardly from the steering shaft and can be used to pivot the drive unit 36 about the steering axis for steering the watercraft.

The clamping bracket 46 includes a pair of bracket arms spaced apart from each other and affixed to the watercraft transom 40. The pivot pin 48 completes a hinge coupling between the swivel bracket 44 and the clamping bracket 46. The pivot pin 48 extends through the bracket arms so that the clamping bracket 46 supports the swivel bracket 44 for pivotal movement about a generally horizontally extending tilt axis defined through the pivot pin 48. Although not shown, a hydraulic tilt system can be provided between the swivel bracket 44 and the clamping bracket 46 to tilt up and down and also to enable trim adjustment of the drive unit 36.

As used through this description, the terms "front," forward" and "forwardly" mean at or to the side where the clamping bracket 46 is located, and the terms "rear," "rearward," "rearwardly" and "reverse" mean at or to the opposite side of the front side, unless indicated otherwise or otherwise readily apparent from the context of use.

Because the construction of the bracket assembly 38 is well known in the art, a further description of the assembly is not believed to be necessary to permit those skilled in the art to practice the present invention.

The drive unit 36 includes a power head 58, a driveshaft housing 60 and a lower unit 62. The power head 58 is disposed atop of the drive unit 36 and includes the aforenoted engine 34 and a protective cowling assembly 66. The protective cowling assembly 66 includes a top cowling member 68 and a bottom cowling member 70.

The cowling assembly 66 generally completely encloses the engine 34. That is, the cowling assembly 66 defines a generally closed cavity 72 in which the engine 34 is contained. The top cowling member 68 is detachably affixed to the bottom cowling member 70 so that the operator can access the engine 34 for maintenance or for other purposes.

Figure 2:
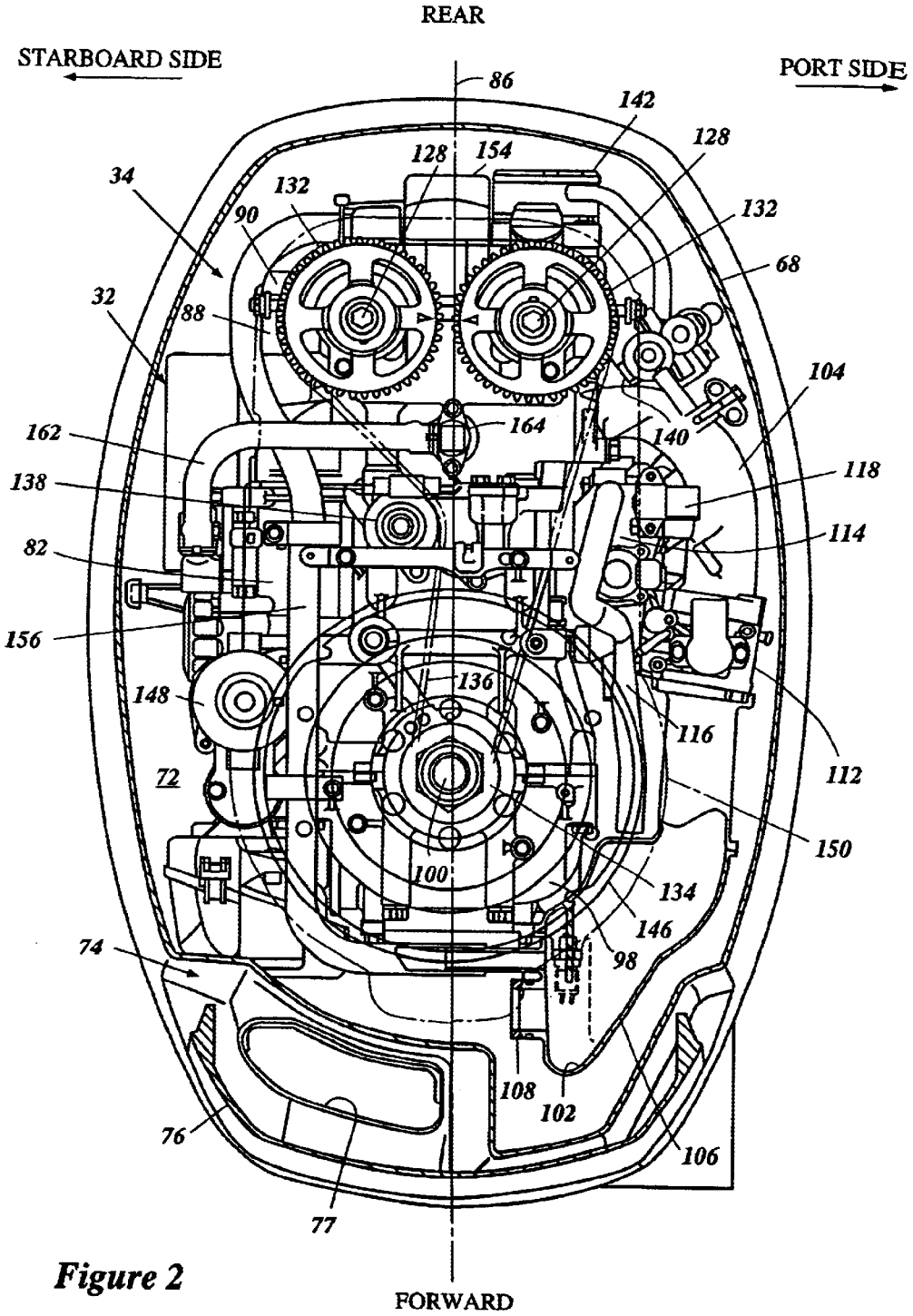
FIG. 2 is a top plan view of the outboard motor. A top cowling is sectioned along the line 2—2 of FIG. 1.

With reference to FIG. 2, in the illustrated arrangement, an air intake opening 74 is defined by the top cowling member 68 and a cover member 76 at a forward portion of the cowling member 68. The top cowling member 68 has an air intake duct 77 that is covered by the cover member 76 to define a passage through which ambient air is introduced into the cavity 72. The illustrated top cowling member 68 includes an opening 78 at a rear portion of the top cowling member 68 and another air intake duct internally of the opening 78. Thus, ambient air also can be introduced into the cavity 72 through the opening 78 and the intake duct.

The bottom cowling 70 has an opening at its bottom portion through which an exhaust guide 80 extends. The exhaust guide 80 preferably is affixed atop the driveshaft housing 60. The bottom cowling 70 and the exhaust guide 80, thus, generally form a tray. The engine 34 is placed on this tray and is affixed to the exhaust guide 80. The exhaust guide 80 also has an exhaust passage therein through which a burnt charge, i.e., exhaust gases, are discharged as described later.

The engine 34 in the illustrated arrangement operates on a four-stroke combustion principle and powers a propulsion device. The engine 34 has a cylinder body 82. The cylinder body 82 defines four cylinder bores 84, which are spaced apart from each other generally vertically and which extend generally horizontally along a major axis 85 of the engine 34. As illustrated, the major axis 85 preferably extends between the front and rear ends of the engine 34. That is, the engine 34 is an L4 (in-line four cylinder) type. This type of engine, however, is merely exemplary of a type on which various aspects and features of the present invention can be used. Engines having other numbers of cylinders, having other cylinder arrangements, and operating on other combustion principles (e.g., crankcase compression two-stroke or rotary) are all practicable.

A piston 86 can reciprocate in each cylinder bore 84. A cylinder head member 88 is affixed to one end of the cylinder body 82 to define combustion chambers 89 with the pistons 86 and the cylinder bores 84. A cylinder head cover member 90 is affixed to and covers the cylinder head member 88. The cylinder head member 88 and cylinder head cover member 90 together form a cylinder head assembly 94.

The other end of the cylinder body 82 is closed with a crankcase member 98 defining a crankcase chamber with the cylinder bores 84. A crankshaft 100 extends generally vertically through the crankcase chamber. The crankshaft 100 is rotatably connected to the pistons 86 by connecting rods 101 and is driven by the reciprocal movement of the pistons 86. In the illustrated arrangement, the crankcase member 98 is located at the most forward position, then the cylinder body 82 and the cylinder head assembly 94 extend rearwardly from the crankcase member 98 one after another.

The engine 34 includes an air induction system. The air induction system is arranged to supply air charges to the combustion chambers 89 and comprises a plenum chamber 102, main air delivery conduits 104 and intake ports. The intake ports are defined through the cylinder head member 88 and can be opened or closed by intake valves. When each intake port is opened, the corresponding air delivery conduit 104 communicates with the respective combustion chamber 89.

The plenum chamber 102 functions as an intake silencer and/or a coordinator of air charges. A plenum chamber member 106 defines the plenum chamber 102 and is mounted on the port side of the illustrated crankcase member 98. The plenum chamber member 106 has an air inlet opening 108 that opens to the cavity 72. The air delivery conduits 104 extend rearwardly from the plenum chamber member 106 along the cylinder body 82 on the port side and then bend toward the intake ports. Air passes into the plenum chamber 102 through the inlet opening 108 from the cavity 72 and is supplied to the combustion chambers 89 through the delivery conduits 104 and the intake ports.

The main air delivery conduits 104 include one or more throttle bodies 112. The respective throttle bodies 112 feature butterfly-type throttle valves mounted therein for pivotal movement about axes of valve shafts that extend generally vertically. The valve shafts are linked together to form a single valve shaft that passes through the entire throttle body 112. The throttle valves are operable by the operator through a suitable throttle cable and a linkage mechanism so that the valves allow a proper air flow rate to pass through the respective delivery conduits 104 in response to engine demands. When the operator operates the throttle cable, the linkage mechanism moves the valve shaft to open the throttle valves. Conversely, when the throttle cable is released, the linkage mechanism moves the valve shaft to close the throttle valves.

The air induction system further includes an idle air supply unit 114. The idle air supply unit 114 bypasses the throttle valves. An upstream bypass conduit 116 couples the unit 114 with the plenum chamber member 106, while a downstream bypass conduit 118 couples the unit 114 with one of the delivery conduits 104. The idle air supply unit 114 contains a valve member pivotally disposed therein. When the throttle valves in the throttle bodies 112 are almost closed, such as at idle, the valve member in the idle air supply unit 114 is operated to supply sufficient air to the combustion chambers 89 under control of an ECU (Engine Control Unit), which is an electrically operable control device.

The engine 34 communicates with an exhaust system that includes the exhaust unit 32. The exhaust system is arranged to discharge exhaust gases from the combustion chambers 89 to a location outside of the outboard motor 30. Exhaust ports 120 are defined in the cylinder head member 88 and can be opened and closed by exhaust valves 122. The cylinder body 82 defines an internal exhaust manifold 124 downstream of the exhaust ports 120. When the exhaust ports 120 are opened, the combustion chambers 89 communicate with the exhaust manifold 124. The exhaust manifold 124 thus combines the exhaust gases flowing from each combustion chamber and guides the exhaust flow to the exhaust unit 32.

Figure 3:
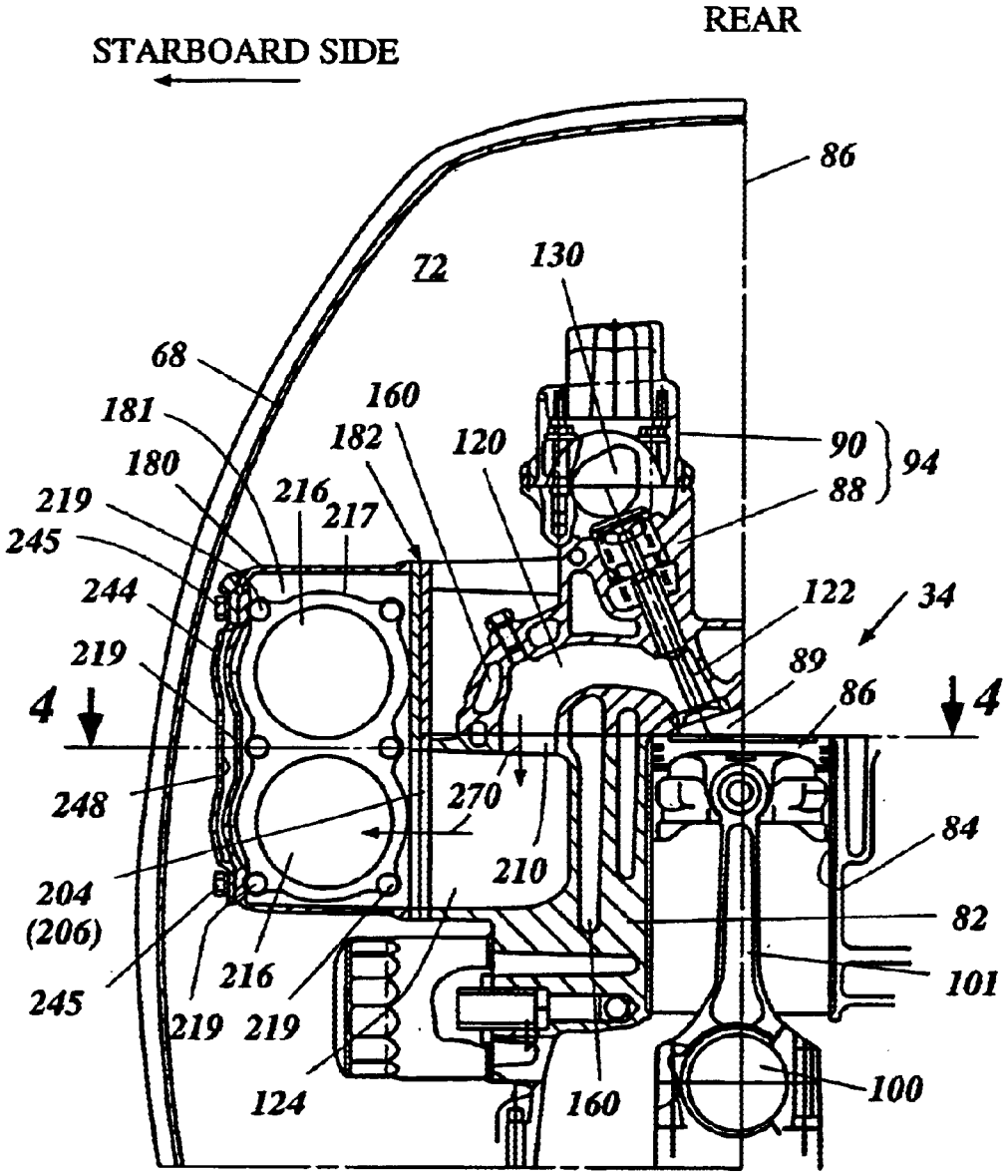
FIG. 3 is a partial, cross-sectional view showing a section through an engine of the motor taken along the line 3—3 of FIG. 4. The rear/starboard side quarter generally is illustrated.

As seen in FIGS. 2 and 3, two camshafts 128 extend generally vertically to actuate the intake valves and exhaust valves 122. The camshafts 128 have cam lobes 130 thereon to push the intake valves and exhaust valves 122 at certain timings such that the intake ports and the exhaust ports 120 are opened and closed. The camshafts 128 are journaled on the cylinder head assembly 94 and are driven by the crankshaft 100. The respective camshafts 128 have sprockets 132 thereon, while the crankshaft 100 also has a sprocket 134 thereon. A timing belt or chain 136 is wound around the sprockets 132, 134. Thus, when the crankshaft 100 rotates, the camshafts 128 also rotate. A tensioner 138 is also provided to adjust the tension of the belt or chain 136 by pushing it inwardly so as to keep the opening and closing timing of the intake and exhaust valves accurately and reduce the likelihood that the chain will jump from a sprocket. The tensioner 138 includes, for example, a gas cylinder containing compressed gases therein to produce the tensioning force.

In the illustrated embodiment, the engine 34 has a fuel injection system, although any other conventional fuel supply and charge forming systems can be applied. The fuel injection system includes four fuel injectors 140 which have injection nozzles directed to the respective intake ports. The fuel injectors 140 are supported by a fuel rail that is affixed to the cylinder head member 88. The fuel injection system further includes a vapor separator, several fuel pumps, a pressure regulator, a fuel supply tank, a fuel filter and several fuel conduits connecting those components. Generally the fuel supply tank is disposed on a hull of the watercraft 42 and the other components are placed on the outboard motor 30. One of the fuel pumps is a high pressure pump 142 mounted on the cylinder head cover member 90. An amount of each fuel injection and injection timing are controlled by the ECU.

The engine 34 further has a firing system. Four spark plugs are exposed into the respective combustion chambers 89 and fire an air/fuel charge at a proper timing. This firing timing also is controlled by the ECU. The air/fuel charge is formed with an air charge supplied by the main air delivery conduits 104 or idle air supply unit 114 and a fuel charge sprayed by the fuel injectors 140. The burnt charge, as described above, is discharged through the exhaust system.

A flywheel assembly 146 is affixed atop the crankshaft 100. The flywheel assembly 146 includes a generator to supply electric power to the firing system, to the ECU and to other electrical equipment via a battery usually disposed in the hull of the watercraft 42. A starter motor 148 is mounted on the cylinder body 82 in adjacent to the flywheel assembly 146. A gear of the starter motor 148 can mesh with a ring gear provided on a periphery of the flywheel assembly 146 through a one-way clutch. The starter motor 148 rotates the crankshaft 100 via the flywheel assembly 146 when the operator operates a main switch. Because the starter gear and the ring gear are coupled by the one-way clutch, the crankshaft 100 and the starter motor 148 are disengaged immediately after the engine 34 starts. A protector 150 covers the flywheel assembly 146, starter motor 148, sprockets 132 and the belt 136.

The engine 34 has also a lubrication system. A lubricant reservoir depends from the exhaust guide 80 within the driveshaft housing 60. A lubricant pump is driven by the driveshaft to supply lubricant to various engine components through appropriate galleries. The lubricant then drains to the lubricant reservoir through a variety of return passages. Some of the engine components that are lubricated in this manner include the pistons 86 that reciprocate within the cylinder bores 84. The pistons 86 need the lubrication such that they do not seize on surfaces of the cylinder bores 84 during operation. Piston rings are provided on the pistons 86 to isolate the combustion chambers 89 and the crankcase chambers. At least one piston ring can remove the lubricant from the surfaces of the cylinder bores 84 and can direct the lubricant back toward the crankcase chambers.

Unburned charges containing a small amount of the exhaust gas may leak from the combustion chamber, passed the piston rings and into the crankcase chamber as blow-by gas because of the huge pressure generated within the combustion chambers. The engine 34 has a ventilation system that returns the blow-by gases, which also may contain entrained lubricant, to the induction system for combustion in the combustion chambers 89.

The ventilation system comprises an inner blow-by gas conduit, an oil separator or breather 154 and an outer blow-by gas conduit 156. The inner conduit is formed within the crankcase member 98, the cylinder body 82 and the cylinder head assembly 94 and connects the crankcase chamber with the oil separator 154. The oil separator 154 is mounted on the cylinder head cover member 90 and has a labyrinth structure therein to separate the oil component from the blow-by gases. The outer blow-by gas conduit 156 couples the oil separator 154 to the plenum chamber member 106 to supply the blow-by gases to the induction system.

The engine 34 further has a cooling system that provides coolant to various engine portions, for example, the cylinder body 82 and the cylinder head assembly 94, and also to the exhaust system. In the illustrated arrangement, water is used as the coolant and is introduced from the body of water surrounding the outboard motor 30. The water is delivered through cooling water jackets 160. After passing through the cylinder head 94 and the cylinder body 82, the water is discharged through a discharge conduit 162 and a water drain jacket that is formed in the exhaust unit 32. A thermostat 164 is provided at the most upstream portion of the discharge conduit 162. If the temperature of the water is lower than a preset temperature, the thermostat 164 will close such that water cannot flow passed the thermostat to the discharge conduit 162. In this manner, the engine 64 can warm up properly.

With reference again to FIG. 1, the driveshaft housing 60 depends from the power head 58 and supports a driveshaft which is driven by the crankshaft 100 of the engine 34. The driveshaft extends generally vertically through the exhaust guide 80 and the driveshaft housing 60. The driveshaft housing 60 also includes several internal passages which form portions of the exhaust system. An idle exhaust passage branches from the internal passages and opens to the atmosphere above the body of water. In the illustrated arrangement, an apron 166 covers an upper portion of the driveshaft housing 60. More particularly, the idle exhaust passage extends through an outer surface of the driveshaft housing 60 and the apron 166.

The lower unit 62 depends from the driveshaft housing 60 and supports a propulsion shaft that is driven by the driveshaft. The propulsion shaft extends generally horizontally through the lower unit 62. In the illustrated embodiment, the propulsion device includes a propeller 168 that is affixed to an outer end of the propulsion shaft and is driven thereby. The propulsion device, however, can take the form of a dual, a counter-rotating system, a hydrodynamic jet, or any other suitable propulsion device.

A transmission is provided between the driveshaft and the propulsion shaft. The transmission couples the two shafts, which lie generally normal to each other, (i.e., at a 90° shaft angle) with a bevel gear combination or the like. The transmission has a switchover or clutch mechanism to shift rotational directions of the propeller 168 among forward, neutral or reverse positions. The switchover mechanism is actuated by the operator through a shift linkage including a shift cam, a shift rod and a shift cable.

The lower unit 62 also includes an internal passage that forms a discharge section of the exhaust system. At engine speed above idle, the majority of the exhaust gases are discharged toward the body of water through the internal passage and a hub of the propeller 168. At engine idle, the exhaust gases preferably are discharged only through the aforenoted idle exhaust passage. Because the exhaust pressure under this condition is smaller than the pressure that can overcome the pressure generated by the body of water.

Additionally, the driveshaft housing 60 has a water pump that is driven by the driveshaft and supplies cooling water to the aforenoted cooling system. Water is introduced through a water inlet (not shown) which opens at the lower unit 62. The water inlet is connected to the water pump through an inlet passage and the water pump is connected to the water jackets of the engine portions and the exhaust system including the water jacket 160.

Figure 4:
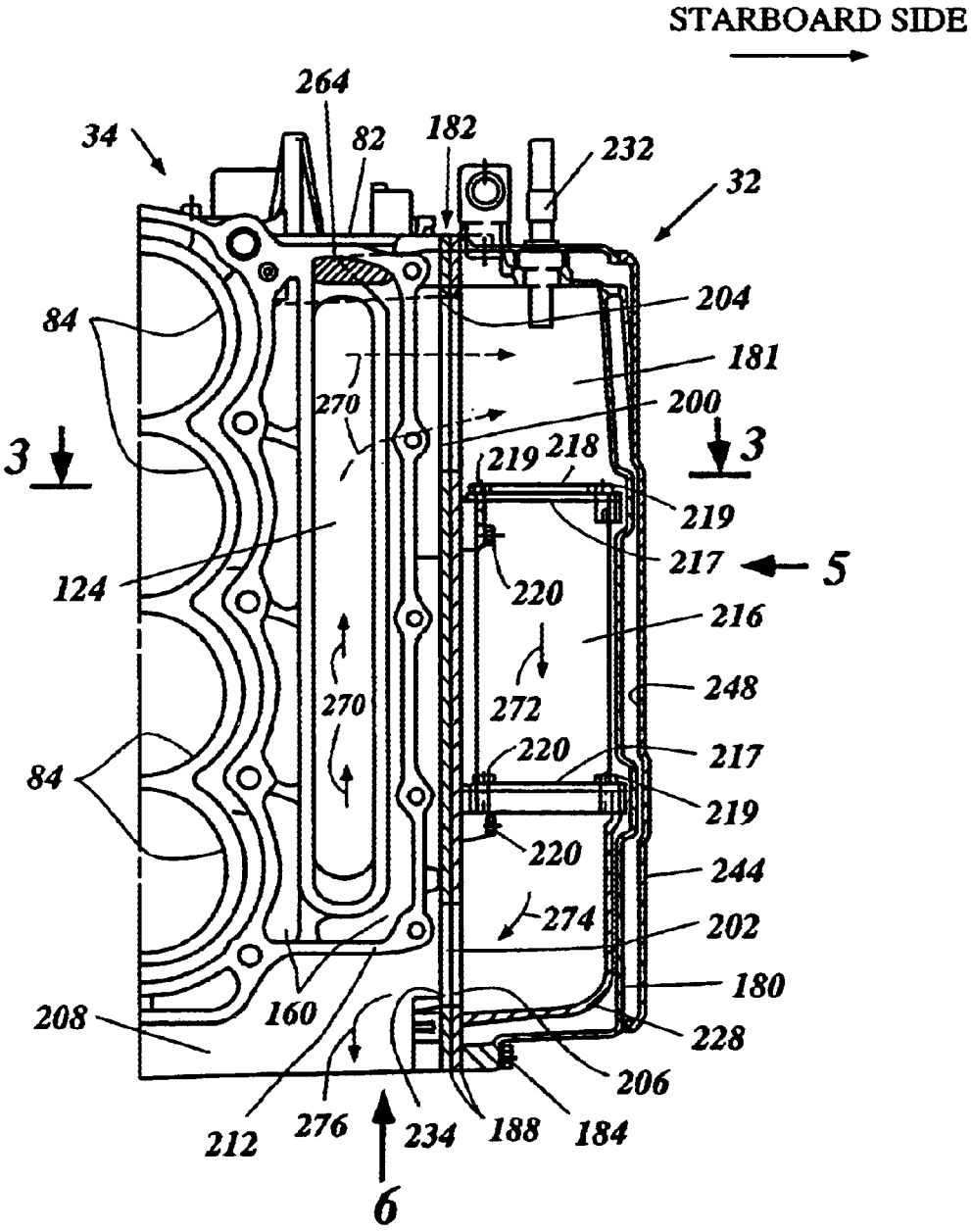
FIG. 4 is a partial, cross-sectional view of the engine taken along the line 4—4 of FIG. 3. The starboard side half generally is illustrated.
Figure 5:
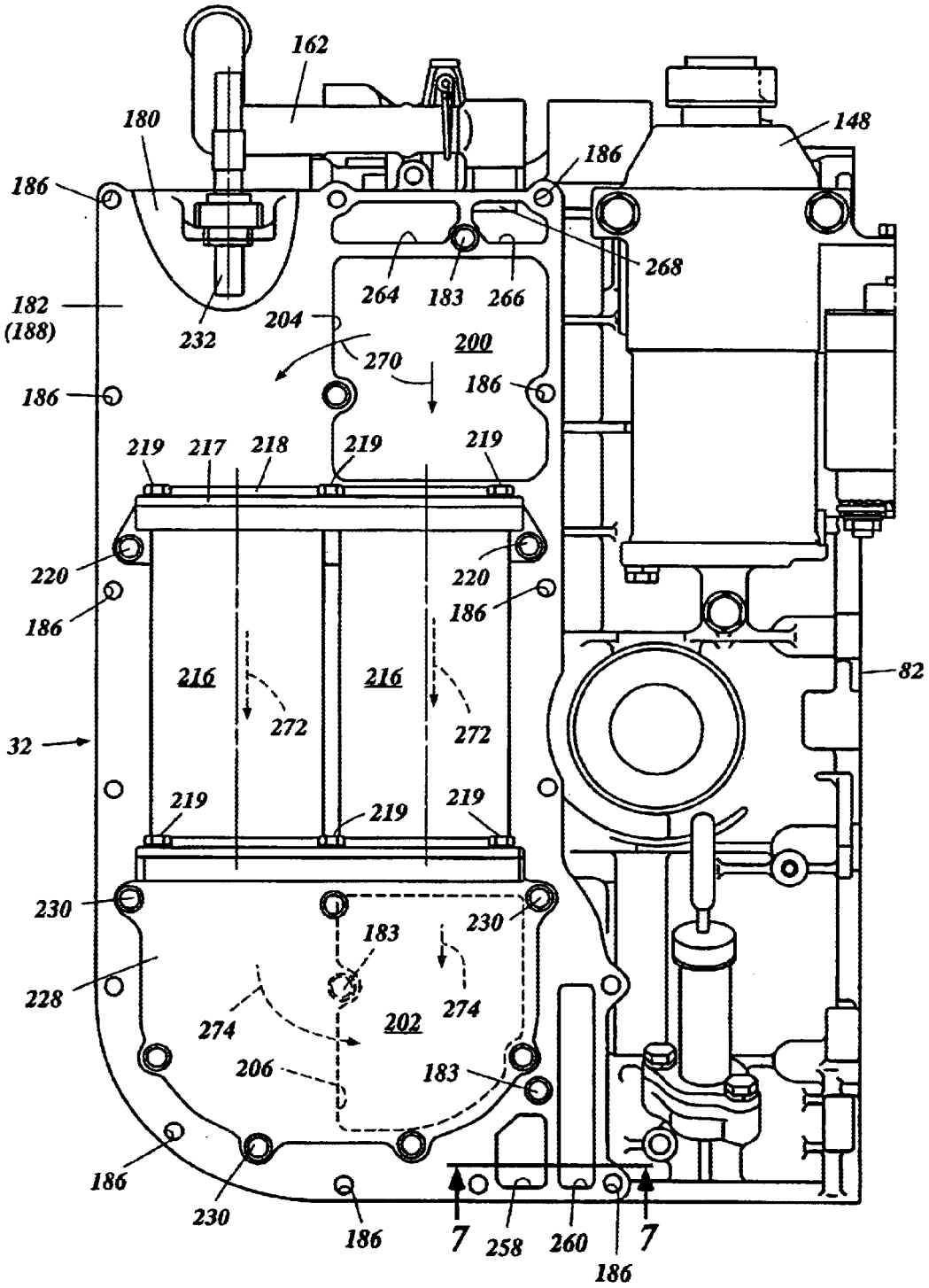
FIG. 5 is a partial, side view of the engine looking in the direction of the Arrow 5 of FIG. 4. Some inner and outer components of the engine are omitted to simplify the drawing.

With primarily reference to FIGS. 3 to 7, the exhaust system will now be described in greater detail. As best seen in FIGS. 3 and 4, in the illustrated arrangement, the exhaust system comprises the exhaust unit 32, which is disposed generally adjacent to the cylinder body 82 and the cylinder head assembly 94, and which is positioned in a space defined between a side surface of the cylinder body 82 and the protective cowling assembly 66. An inner member or exhaust passage member 180 of the exhaust unit 32 comprises a pan-like shape and defines a supplement exhaust passage 181. As best seen in FIG. 3, the inner member 180 generally is rectangular in section. The inner member 180 is affixed to the cylinder body 82 via a supporting plate or spacer assembly 182. That is, the spacer assembly 182 is interposed between the inner member 180 and the cylinder body 82 to couple the two components. The spacer assembly 182 is affixed to the cylinder body 82 by bolts 183 (see FIG. 5) via a sealing member. In addition, the inner member 180 and the spacer assembly 182 are affixed to the cylinder body 82 by bolts 184. Bolt holes 186 are provided for accommodating the bolts 184 as seen in FIG. 5.

The spacer assembly 182 includes two spacer pieces 188 that have generally the same configuration. The cylinder body 82 also comprises two openings 200, 202 that are vertically spaced from each other. Similarly, the spacer assembly 182 comprises two openings 204, 206 that are vertically spaced and that correspond to the openings 200, 202. The lower opening 202 of the cylinder body 82 comprises a port of a discharge passage 208 that is formed below the exhaust manifold 124. The supplemental passage 181 communicates with the exhaust manifold 124 through the upper openings 200, 204 and also with the discharge passage 208 through the lower openings 202, 206. In the illustrated arrangement, both the exhaust manifold 124 and the discharge passage 208 are formed within the cylinder body 82. However, the two are separated from each other by a partition or rib 212. The exhaust manifold 124 communicates with the respective exhaust ports 120. FIG. 4 shows a unified portion 210 positioned downstream of the respective exhaust ports 120. The discharge passage 208, in turn, communicates with the exhaust passage in the exhaust guide 80.

A plurality of monolithic catalyzers 216 are provided in the supplemental passage 181. In the illustrated arrangement, the exhaust unit 32 contains two catalyzers 216 which preferably are cylindrical in shape. The bodies of the catalyzers 216 are enclosed in metal cases which also have cylindrical shapes. As best seen in FIG. 5, the catalyzers 216 preferably are disposed in parallel to each other relative to the exhaust flow in the passage 181.

The catalyzer 216 causes a chemical reaction that renders certain of the exhaust gas constituents harmless. The catalyzer 216 has a carrier member that carries, for example, a three-way catalyst element. The three-way catalyst element can oxidize CO and HC and reduce NOx contained in the exhaust gases. Thus, the gases are purified when passing through the catalyzer 216. It should be noted, however, any conventional catalyzers can be used depending upon the application and the desired effects.

Figure 6:
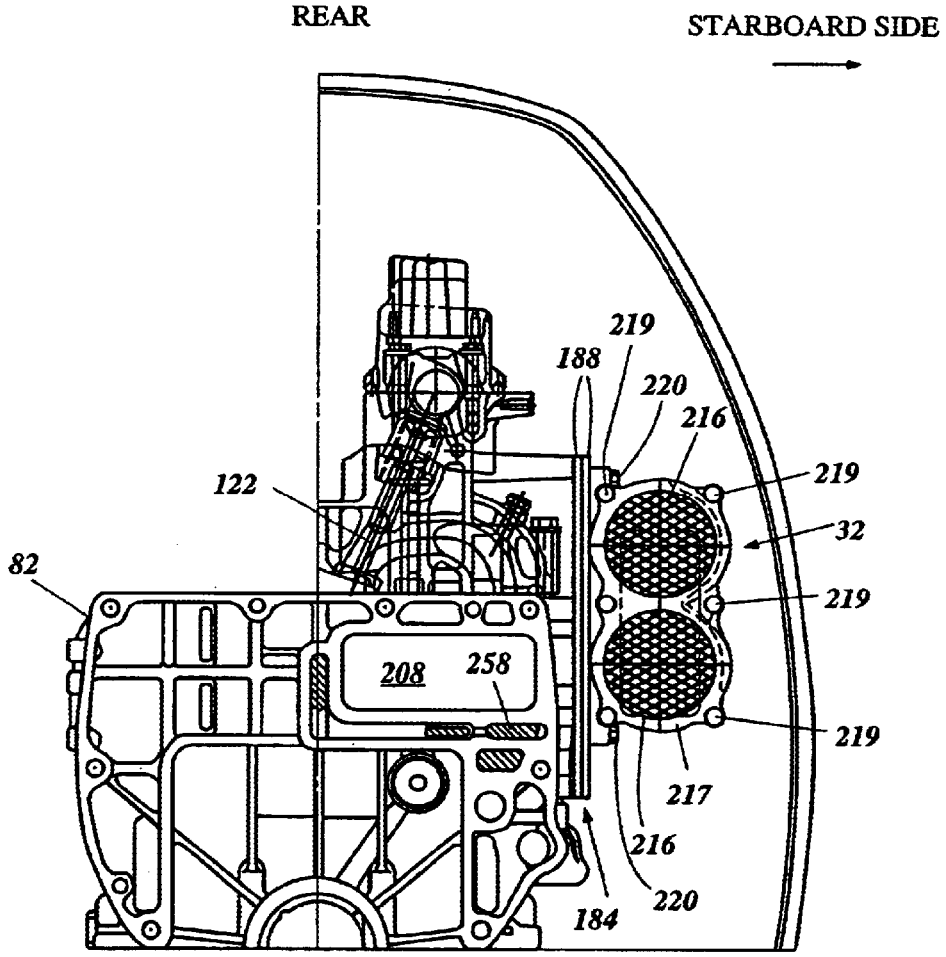
FIG. 6 is a partial sectional, bottom plan view of the engine looking in the direction of the Arrow 6 of FIG. 4. Some inner and outer components of the engine are omitted to simplify the drawing.

The catalyzers 216 are interposed between a pair of brackets 217 that are vertically spaced from each other. As best seen in FIGS. 3, 5 and 6, each bracket 217 is configured generally as a dual ring construction and both end portions 218 of the catalyzers 216 slightly protrude from throughholes of the brackets 217. The brackets 217 are united with the metal cases of the catalyzers with bolts 219 and affixed to the spacer assembly 182 by a plurality of bolts 220.

In the illustrated embodiment, a guide member 228 is additionally affixed to the spacer assembly 182 by bolts 230 and a sealing member is interposed therebetween. A skirt portion 231 (see FIG. 5) of the lower bracket 217 overlaps with the upper portion of the guide member 228. The guide member 228 preferably has a half-dome shape to lead the exhaust gases toward the lower opening 202

An air fuel ratio sensor or oxygen ($O_2$) sensor 232 is affixed to a top portion of the inner member 180 so that a sensor element thereof is exposed to the supplemental passage 181. The oxygen sensor 232 sends a signal to the ECU. The ECU controls the fuel injection system, firing system or the like based upon signals sent thereto by sensors such as the oxygen sensor 232. An exhaust temperature sensor 234 is provided for indirectly monitoring the temperature of the catalyzers 216. The temperature sensor 234 is placed in the discharge passage 208. Preferably, the sensor 234 is affixed to the spacer assembly 182 in one arrangement. The ECU also can use the output this sensor 234 in its control of the aforenoted systems.

Figure 7:
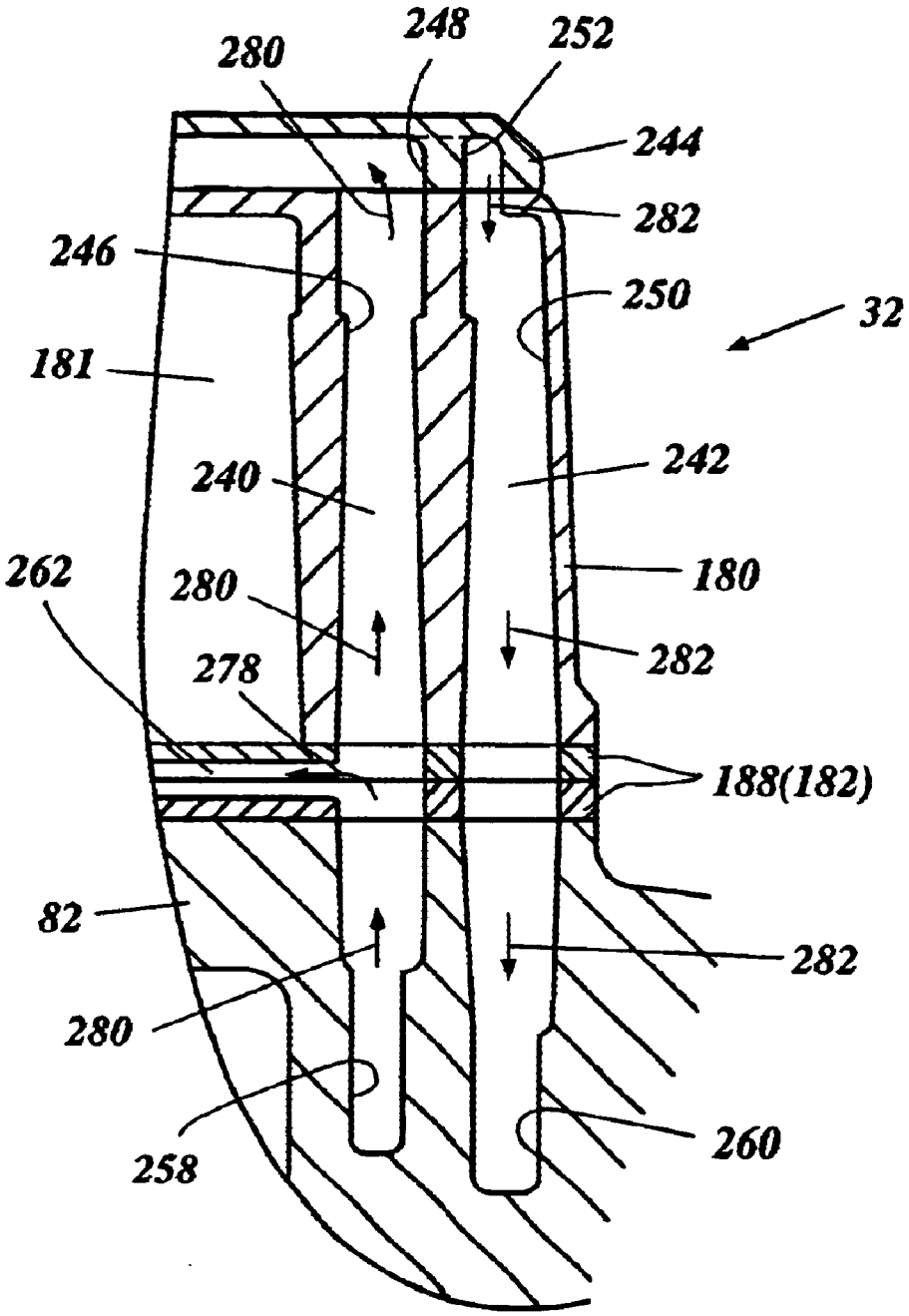
FIG. 7 is a partial, cross-sectional view of the engine taken along the line 7—7 of FIG. 5.

As best seen in FIG. 7, the exhaust unit 32 additionally comprises a water supply jacket 240 and a water drain jacket 242. An outer member 244 overlies and is affixed to the inner member 180 by bolts 245. The supply jacket 240 comprises an internal supply passage 246 defined in the inner member 180 and an external supply passage 248 defined between the inner member 180 and the outer member 244. The drain jacket 242, in turn, comprises an internal drain passage 250 defined in the inner member 180 and an external drain passage 252 defined between the inner member 180 and the outer member 244. The respective external passages 248, 252 are divided by a partition 254 of the outer member 244 and extend along the exhaust passage 181 next to each other. Any ratio for allotting areas for the respective external passages 248, 252 can be selected. Preferably, however, the area for the supply passage 248 is greater than the area for the drain passage 252 because the supply water is cooler than the drain water.

The internal supply passage 246 also connects to a water supply jacket 258 defined in the cylinder body 82 and is coupled to the aforenoted water pump. Hatched portions of the jacket 258 in FIG. 6 indicate that these portions extend to deeper passages defined in the cylinder body 82. The other hatched portions in FIGS. 4 and 6 indicate similar constructions. The internal drain passage 250, in turn, connects to a water drain jacket 260, which also is defined in the cylinder body 82 and which couples to a water drain from the outboard motor 30. As seen in FIG. 7, the spacer assembly 182 has a branch passage 262 defined between the respective spacer pieces 188. The branch passage 262 connects to both the internal supply passage 246 and the water supply jacket 258 so that the supply water can be directed to the supply passage 246 and to the branch passage 262 from the supply jacket 258.

The external supply passage 248 connects to a water supply inlet 264 that is in communication with water supply jackets defined in the cylinder head assembly 94. For instance, as seen in FIG. 4, the supply inlet 264 and the external supply passage 248 are coupled to the water jacket 160. The external drain passage 252 is connected to a water drain outlet 266, which is coupled to the water discharge conduit 162. A discharge opening 268 of the discharge conduit 162 is positioned at the drain outlet 266. Thus, all of the water that has passed through the thermostat 164 can be directed to the external drain passage 252.

The water supply jacket 240 of the exhaust unit 32, in other words, forms a portion of the water supply plumbing that originates at the cylinder body 82 and that extends to the cylinder head assembly 94, while the water drain jacket 242 forms a portion of the water drain plumbing that originates at the cylinder head assembly 94 and that extends to the cylinder body 82. In addition, the branch passage 262, which is defined within the spacer assembly 182, forms another portion of the water supply plumbing.

In the illustrated embodiment, the spacer assembly 182 includes the branch passage 262, which acts as a supply passage. However, the spacer assembly 182 can be provided with another branch passage that acts as a drain passage. Alternatively, the branch passage 262 itself can be the drain passage instead of being the supply passage so long as the exhaust unit 32 includes the supply jacket 240.

When the engine 34 operates, exhaust gases are produced in the combustion chambers 89. The gases as directed through the exhaust ports 120 when the exhaust valves 122 are opened by the cam mechanism. The exhaust gases merge in the exhaust manifold 124 and are directed to the supplemental passage 181 in the exhaust unit 32, as indicated by the arrows 270 of FIGS. 3 to 5. The exhaust gases then flow into the catalyzers 216 to be purified, as indicated by the arrows 272 of FIGS. 4 and 5. After passing through the catalyzers 216, the gases are directed through the guide member 228 and into the discharge passage 208, as indicated by the arrows 274 of FIGS. 4 and 5. The gases, then, are directed into the exhaust passage in the exhaust guide 80, as indicated by the arrow 276 of FIG. 4. From the exhaust passage in the exhaust guide 80, the gases are discharged to the body of water through the hub of the propeller 168 or to the atmosphere as described above.

Cooling water moves into the water supply jacket 258 in the cylinder body 82 from the aforenoted water pump. A certain part of the water is diverted to the branch passage 262 of the spacer assembly 182 and is passed to the water supply jackets of the cylinder head assembly 94, as indicated by the arrow 278 of FIG. 7. A major portion of the water, however, flows into the water supply jacket 240 of the exhaust unit 32 and is directed to the supply inlet 264, as indicated by the arrows 280 of FIG. 7. The water then circulates in the water jackets, which include the jacket 160 formed within the cylinder body 82 and the cylinder head assembly 94, to take heat therefrom. The water, after the circulation, returns to the drain outlet 266 through the discharge conduit 162 and flows through the water drain jacket 242 of the exhaust unit 32, as indicated by the arrows 282 of FIG. 7. The water then is directed to certain discharge passages defined in the outboard motor 30 such that the water is discharged to the body of water. While flowing through both the supply jacket 240 and the drain jacket 242, the water absorbs heat accumulated in the catalyzers 216 as well as in the exhaust passage 181.

As described above, the exhaust unit 32 in the illustrated embodiment is provided downstream of the exhaust manifold and includes the exhaust passage 181 that extends within a space defined between a side surface of the cylinder body 82 and the protective cowling assembly 66. This arrangement does not require any large space that must be specially created for the exhaust unit 32. Nevertheless, the exhaust unit 32 can hold two catalyzers 216 that have relatively large volumes. Additionally, because the catalyzers 216 are generally confined solely in the exhaust unit 32 and because the catalyzers 216 are not exposed to the body of water in the illustrated arrangement, no particular protection for the catalyzers is necessary to guard against water that may damage the catalyzers 216.

In the illustrated arrangement, the inner and outer members 180, 244 and the guide member 228 can be easily detached from one another and from the spacer assembly 182. After removing all of the members 180, 244, 228, the catalyzers 216 can be removed from the brackets 217. Thus, this illustrated construction eases maintenance and exchange of the catalyzers 216.

Figure 8:
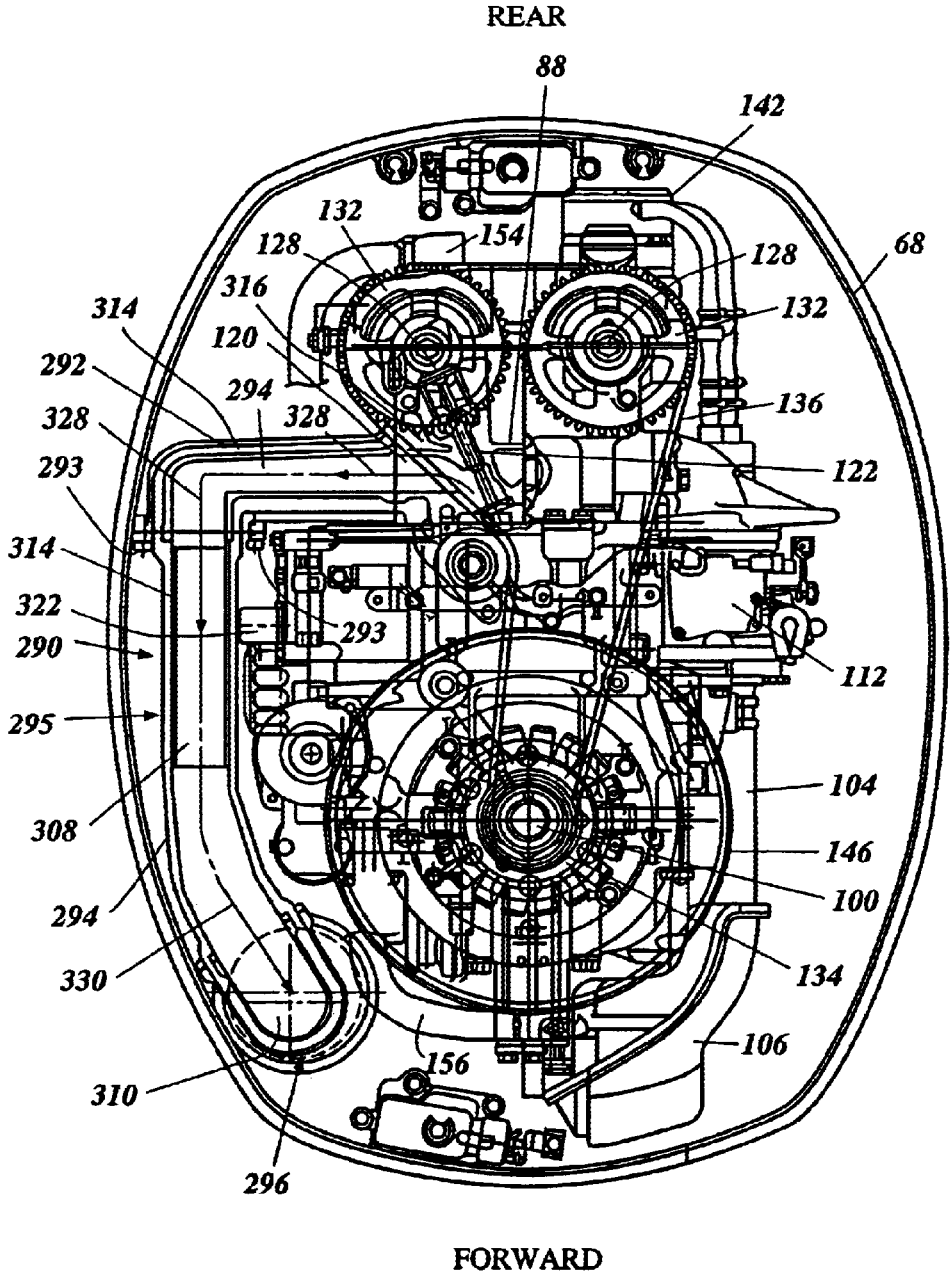
FIG. 8 is a top plan view of an outboard motor that employs an exhaust unit configured in accordance with another arrangement of the present invention. A top cowling is sectioned along a line similar to the line 2—2 of FIG. 1.
Figure 9:
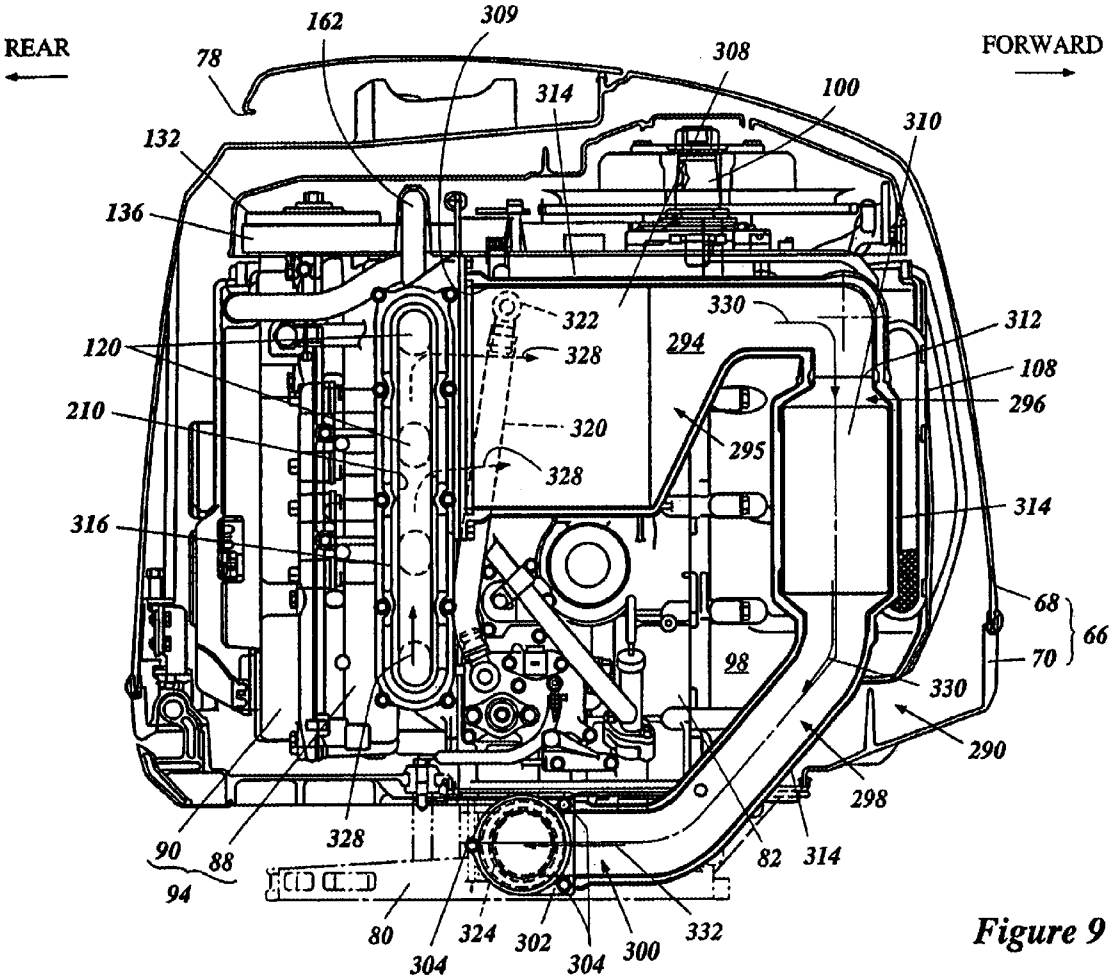
FIG. 9 is a side elevational view of the motor of FIG. 8. A protective cowling is sectioned along a generally vertical center plane. To simplify the drawing, an exhaust manifold is omitted.

With reference to FIGS. 8 and 9, another exhaust unit 290 configured in accordance with another arrangement having certain features and aspects of the present invention will be described. The same members and components that have already been described in connection with the first arrangement will be assigned the same reference numerals and will not be described again unless a particular need for such a repeated description exists.

As seen in FIG. 8, an exhaust manifold 292 extends generally horizontally toward the top cowling member 68 on the starboard side of the exhaust ports 120 and then turns generally forwardly. The exhaust unit 290 is coupled to the exhaust manifold 292 by bolts 293 and extends forwardly along the cylinder body 82 and the crankcase member 98. The exhaust manifold 292 and the exhaust unit 290 together define an exhaust passage 294 therein. As seen FIG. 9, the exhaust unit 290 then turns downwardly at an angle to extend generally horizontally and rearwardly. The exhaust manifold 292, an upper horizontal portion 295, a vertical portion 296 and a major part of an angled portion 298 are disposed within the protective cowling assembly 66. The rest part of the angled portion 298 and a lower horizontal portion 300 extend out of the cowling assembly 66 and are coupled to the exhaust passage in the exhaust guide 80 at a coupling portion 302. This coupling portion 302 is affixed to the exhaust guide 80 by bolts 304.

The upper horizontal portion 295 has a generally rectangular shape that is relatively slim in a transverse direction but voluminous in a longitudinal direction. A first monolithic catalyzer 308 is disposed in this upper horizontal portion 295. Because of the configuration of the horizontal portion 295, the catalyzer 308 is configured as a rectangular shape that is thin in the transverse direction but thick in the longitudinal direction. The rest of the horizontal portion 295 is reduced in volume. The catalyzer 308 can be detached from an opening 309 that is so formed that the catalyzer 308 can pass through. The vertical portion 296, in turn, has a generally cylindrical shape. A second monolithic catalyzer 310 is disposed in this vertical portion 296. The second catalyzer 308 has also a cylindrical shape complying with the cylindrical configuration of the vertical portion 296. The rest of the vertical portion 296 as well as the angled portion 298 and the lower horizontal portion 300 are narrowed to be generally the same dimension as the reduced part of the upper horizontal portion 295. In the illustrated embodiment, the vertical portion 296 is actually separately formed from the horizontal portion 295 and both portions 295, 296 are mated together at a juncture 312 that preferably is disposed immediately above the second catalyzer 310. The first catalyzer 308 and the second catalyzer 310 in this arrangement are disposed in series with each other.

The exhaust unit 290 and the manifold 292 in this embodiment have a cooling water jacket 314 that generally surrounds the exhaust passage 294. The cooling water preferably is supplied from the water jacket 316 of the cylinder head member 88. Additionally, the exhaust unit 290 has a special water supply. The water supply comprises a water delivery pipe 320 that communicates to one of the water passages coming from the water pump. The delivery pipe 320 is coupled to the exhaust unit 290 with a coupler 322. Through this delivery pipe 320, fresh water can be supplied to the water jacket 314 in addition to the water that has circulated within the cylinder body 82 and the cylinder head assembly 94. The coupling portion 302 also has a water jacket 324 around its exhaust passage. The water jacket 324 is coupled to the internal water passage defined in the exhaust passage that communicates to the water discharge passage.

Exhaust gases move to the exhaust passage 294, which is defined in both the exhaust manifold 292 and the exhaust unit 290, from the exhaust ports 316 that are defined in the cylinder head member 88. The exhaust gases then flow into the first catalyzer 308 as indicated by the arrows 328 of FIGS. 8 and 9. The first catalyzer 308 purifies the gases. The exhaust gases then are directed to the second catalyzer 310 to be cleaned thereby as indicated by the arrows 330 of FIGS. 8 and 9. After being cleaned, they are directed toward the exhaust guide 80 and flow into it through the coupling portion 302 as indicated by the arrow 332 of FIG. 9.

Cooling water is supplied to the water jacket 314 from both the water jacket 316 and the water delivery pipe 320. The water absorbs heat from the first and second catalyzers 308, 310 and from the exhaust gases passing through the exhaust manifold 292 and the exhaust unit 290.

In the illustrated arrangement, the exhaust unit 290 extends forwardly and connects to the exhaust guide 80. However, other arrangements are practicable. For instance, the unit 290 can extend rearwardly and can connect directly to the internal passages of the exhaust system formed within the driveshaft housing 60.

Any number, size, configuration and position of the catalyzers can be selected in accordance with certain of the features and aspects of the present invention. For example, three rectangular shaped catalyzers that are longer than the illustrated catalyzers 216 can be placed at higher or lower positions and can be disposed in parallel or in series.

The spacer assembly or supporting plate can be omitted and the exhaust unit can be mounted directly on a portion of the engine. However, the spacer assembly can contribute to increasing the number of alternative constructions of the exhaust unit without changing the particular engine configuration.

The water jackets of the exhaust unit are optional in some applications. If the water jackets are not provided in the exhaust unit, the water jackets of the cylinder body can be coupled directly with the water jackets of the cylinder head assembly. Conversely, the exhaust unit can be more perfectly surrounded by water jackets. Whether one increases or decreases the surface area of water jackets depends upon the particular thermal characteristics of the chosen exhaust unit.

In the illustrated arrangements, the exhaust units contain monolithic catalyzers of a single type. However, the respective catalyzers can be different relative to each other. For instance, it is practicable that one catalyzer has a three-way catalyst element and the other one has a catalyst element that works specifically on oxide of nitrogen (NOx). The arrangement featuring different catalyzers is particularly effective when the catalyzers are placed in series because the differing location along the exhaust system results in different exhaust gas temperatures, which can be varied to suit the particular catalyst elements being used. Moreover, either one of the inner and outer members or both of them can have fins thereon to expedite the cooling effect.

Although the present invention has been described in terms of certain preferred arrangements, other arrangements apparent to those of ordinary skill in the art also are within the scope of this invention. Thus, various changes and modifications may be made without departing from the spirit and scope of the invention. Moreover, not all of the features aspects and advantages are necessarily required to practice the present invention. Accordingly, the scope of the present invention is intended to be defined only by the claims that follow.

What is claimed is:

1. An internal combustion engine for an outboard motor comprising a cylinder body in which a plurality of cylinder bores are spaced apart from each other along a generally vertically extending plane, an exhaust manifold gathering exhaust gases from the respective cylinder bores, the exhaust manifold extending generally along the cylinder body to define first and second ends, an exhaust passage coupled to the exhaust manifold at the first end of the exhaust manifold and extending generally along the exhaust manifold toward a location positioned adjacent to the second end of the exhaust manifold so that the exhaust manifold is interposed between the cylinder body and the exhaust passage, and a catalyzer being disposed in the exhaust passage.

2. The internal combustion engine as set forth in claim 1 additionally comprising an exhaust passage member defining the exhaust passage, the cylinder body and the exhaust manifold being monolithic and the exhaust passage member being affixed to the cylinder body.

3. The internal combustion engine as set forth in claim 2 additionally comprising a spacer interposed between the exhaust passage member and the cylinder body.

4. The internal combustion engine as set forth in claim 3, wherein the spacer supports the catalyzer.

5. The internal combustion engine as set forth in claim 3, wherein the spacer is formed by at least two pieces, and the pieces define a coolant passage therebetween.

6. The internal combustion engines as set forth in claim 2, wherein the exhaust passage member has an outer member affixed thereon, and the exhaust passage defines a coolant passage with the outer member therebetween.

7. The internal combustion engine as set forth in claim 1, wherein the cylinder bank, the exhaust manifold and the exhaust passage extend generally vertically.

8. The internal combustion engine as set forth in claim 1, wherein the exhaust passage communicates with a discharge passage defined within the cilynder body downstream of the catalyzer.

9. The internal combustion engine as set forth in claim 1, wherein the exhaust manifold is unified with the cylinder body.

10. The internal combustion engine as set forth in claim 1, wherein the exhaust passage adjoins a coolant passage.

11. The internal combustion engine as set forth in claim 10 additionally comprising a cylinder head that closes one end of the cylinder bore, and the coolant passage communicating with the cylinder head.

12. The internal combustion engine as set forth in claim 1, wherein the respective cylinder bores are spaced apart from each other generally vertically and extend generally horizontally.

13. The internal combustion engine as set forth in claim 1, wherein the engine operates on a four-stroke combustion principle.

14. The engine as set forth in claim 1, wherein the exhaust passage contains a plurality of catalyzers.

15. The engine as set forth in claim 1 additionally comprising an air induction system arranged to introduce air to the combustion chambers, and the air induction system being located on an opposite side of the exhaust passage relative to the engine block.

16. An internal combustion engine for an outboard motor having a protective cowling surrounding the engine, comprising a cylinder body in which a plurality of cylinder bores are spaced apart from each other, an exhaust manifold gathering exhaust gases from the respective cylinder bores, an exhaust passage being coupled to the exhaust manifold, the exhaust passage extending along the exhaust manifold so as to interpose the exhaust manifold between the exhaust-passage and the bores, the exhaust passage being positioned, at least in part, within a space defined between a side surface of the cylinder body and the protective cowling, and at least one catalyzer disposed in the exhaust passage.

17. An internal combustion engine for an outboard motor having a protective cowling surrounding the engine, comprising a cylinder body in which a plurality of cylinder bores are spaced apart from each other, an exhaust manifold gathering exhaust gases from the respective cylinder bores, an exhaust passage coupled to the exhaust manifold and extending, at least in part, within a space defined between a side surface of the cylinder body and the protective cowling, and a plurality of catalyzers disposed in the exhaust passage, the catalyzers being disposed in parallel with each other.

18. An internal combustion engine for an outboard motor having a protective cowling surrounding the engine, comprising a cylinder body in which a plurality of cylinder bores are spaced apart from each other, an exhaust manifold gathering exhaust gases from the respective cylinder bores, an exhaust passage coupled to the exhaust manifold and extending, at least in part, within a space defined between a side surface of the cylinder body and the protective cowling, and a plurality of catalyzers disposed in the exhaust passage, the catalyzers being disposed in series with each other.

19. An internal combustion engine for an outboard motor having a protecive cowling surrounding the engine, comprising a cylinder body in which a plurality of cylinder bores are spaced apart from each other, an exhaust manifold gathering exhaust gases from the respective cylinder bores, an exhaust passage coupled to the exhaust manifold and extending, at least in part, within a space defined between a side surface of the cylinder body and the protective cowling, the exhaust passage including a horizontal section extending generally horizontally along the side surface of the cylinder body, and a vertical section extending generally vertically along the side surface of the cylinder body, and at least two catalyzers, one of the catalyzers being disposed in the horizontal section, and another one of the catalyzers being disposed in the vertical section.

20. An exhaust gas purifying system for an internal combustion engine having a side surface, the system comprising an exhaust passage disposed on the side surface of the engine for catalytic exhaust treatment, the exhaust passage including a vertical section that extends generally vertically along the side surface of the cylinder body, and a horizontal section that extends generally horizontally along the side surface of the cylinder body, a catalyzer disposed within the vertical section, and an additional catalyzer disposed within the horizontal section.

21. An internal combustion engine for an outboard motor comprising an engine block defining multiple bores spaced apart from each other to form a bank, moveable members moveable within the respective bores to form multiple combustion chambers together with the engine block and the bores, the engine block defining an exhaust manifold gathering exhaust gases from the respective combustion chambers, the exhaust manifold extending generally along the bank to define first and second ends, the engine block further defining an exhaust passage coupled with the exhaust manifold at the first end of the exhaust manifold and extending generally along the exhaust manifold toward a location positioned adjacent to the second end of the exhaust manifold so that the exhaust manifold is interposed between the bank and the exhaust passage, and a catalyzer disposed in the exhaust passage.

22. The engine as set forth in claim 21, wherein the engine block comprises a cylinder body and a cylinder head member, the cylinder body defines the bores, and the cylinder head member closes one end of the bores to define the combustion chambers.

23. The engine as set forth in claim 21, wherein the engine block comprises a separable member, the separable member defines the exhaust passage.

24. The engine as set forth in claim 21, wherein the exhaust passage communicates with the engine block at a location adjacent to the second end of the exhaust manifold.

25. The engine as set forth in claim 23, wherein the engine block additionally comprises a spacer, and the separable member is affixed to another portion of the engine block via the spacer.

26. The engine as set forth in claim 25, wherein the spacer defines an opening through which the exhaust passage communicates with the first end of the exhaust manifold.

27. The engine as set forth in claim 26, wherein the spacer defines a second opening through which the exhaust passage communicates with the engine block at a location adjacent to the second end of the exhaust manifold.

28. The engine as set forth in claim 25, wherein the spacer defines a coolant passage through which coolant flows.

29. The engine as set forth in claim 23, wherein the separable member further defines a coolant passage through which coolant flows.

30. The engine as set forth in claim 23, wherein the engine block includes a cylinder body that defines the bores and the separable member is affixed to the cylinder body.

31. The engine as set forth in claim 21, wherein the exhaust passage contains a plurality of catalyzers.

32. The engine as set forth in claim 21, wherein the catalyzers are disposed in parallel to each other.

33. The engine as set forth in claim 21 additionally comprising an air induction system arranged to introduce air to the combustion chambers, and the air induction system being located on an opposite side of the exhaust passage relative to the engine block.

34. An internal combustion engine for an outboard motor comprising an engine block defining multiple bores spaced apart generally vertically from each other, moveable members moveable within the respective bores to form multiple combustion chambers together with the engine block and the multiple bores, the engine block defining an exhaust manifold gathering exhaust gases from the respective combustion chambers, and an exhaust passage member extending along the engine block to define an exhaust passage communicating with the exhaust manifold, the exhaust passage comprising a horizontal section and a vertical section, the exhaust passage containing at least two catalyzers, one of the catalyzers being disposed within the horizontal section, and another one of the catalyzers being disposed within the vertical section.

35. The engine as set forth in claim 34, wherein the exhaust passage member defines a coolant passage through which coolant flows.

36. An outboard motor comprising an engine having a cylinder body defining a plurality of cylinder bores, an exhaust manifold connected to the cylinder bores and configured so as to guide exhaust gases upwardly toward an upper end of the engine, an exhaust passage connected to the exhaust manifold and extending downwardly adjacent to the exhaust manifold so that the exhaust manifold is interposed between the cylinder bores and the exhaust passage, and a catalyzer being disposed in the exhaust passage.

37. The outboard motor according to claim 36 additionally comprising an exhaust guide plate disposed beneath and supporting the engine.

38. The outboard motor according to claim 36, wherein the catalyzer is disposed in a portion of the exhaust passage above the exhaust guide plate and adjacent to the exhaust manifold.

* * * * *